US009631526B2

(12) United States Patent
Nowak

(10) Patent No.: US 9,631,526 B2
(45) Date of Patent: Apr. 25, 2017

(54) ENGINE VARIABLE VALVE LIFT SYSTEM HAVING INTEGRATED HYDRAULIC FLUID RETENTION

(71) Applicant: Peter E Nowak, Huntington Woods, MI (US)

(72) Inventor: Peter E Nowak, Huntington Woods, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 14/848,437

(22) Filed: Sep. 9, 2015

(65) Prior Publication Data

US 2016/0076412 A1 Mar. 17, 2016

Related U.S. Application Data

(60) Provisional application No. 62/051,617, filed on Sep. 17, 2014.

(51) Int. Cl.
*F01L 9/02* (2006.01)

(52) U.S. Cl.
CPC ..... *F01L 9/025* (2013.01); *F01L 9/02* (2013.01); *F01L 9/021* (2013.01); *F01L 9/023* (2013.01)

(58) Field of Classification Search
CPC . F01L 9/025; F01L 9/023; F01L 9/021; F01L 9/02
USPC ..... 123/90.12
See application file for complete search history.

(56) References Cited

U.S. PATENT DOCUMENTS

| | | | | |
|---|---|---|---|---|
| 4,765,288 | A | 8/1988 | Linder et al. | |
| 8,307,793 | B2 | 11/2012 | Paolo et al. | |
| 2009/0120389 | A1 | 5/2009 | Rauch et al. | |
| 2010/0224148 | A1* | 9/2010 | Kuhl | F01L 9/025 123/90.12 |

FOREIGN PATENT DOCUMENTS

| | | | |
|---|---|---|---|
| EP | 1243761 | A1 | 9/2002 |
| EP | 1555398 | A1 | 7/2005 |
| EP | 2261471 | A1 | 12/2010 |
| JP | H02221610 | A | 9/1990 |

OTHER PUBLICATIONS

International Search Report and Written Opinion dated Nov. 26, 2015 for International Application No. PCT/US2015/049954, International Filing Date Sep. 14, 2015.

* cited by examiner

*Primary Examiner* — Zelalem Eshete
(74) *Attorney, Agent, or Firm* — Ralph E. Smith

(57) ABSTRACT

An electro-hydraulic variable valve lift system includes a medium pressure chamber, a high pressure circuit, a valve, a pump and an actuator. The chamber is formed in a cylinder head assembly and is in fluid communication with a hydraulic fluid source. The high pressure circuit is positioned in the cylinder head assembly and is in selective fluid communication with the chamber. The valve is in fluid communication with the chamber and the high pressure circuit, and the pump is configured to pump hydraulic fluid in the high pressure circuit. The actuator is in fluid communication with the pump, control valve and high pressure circuit, and is in engagement with an intake valve. The chamber and the actuator are each positioned in the cylinder head assembly at a location above the valve such that during an engine shutdown event, hydraulic fluid is retained in the chamber and the valve.

11 Claims, 4 Drawing Sheets

ENGINE VARIABLE VALVE LIFT SYSTEM HAVING INTEGRATED HYDRAULIC FLUID RETENTION

CROSS-REFERENCE TO RELATED APPLICATIONS

This application claims the benefit of U.S. Provisional Application No. 62/051,617, filed on Sep. 17, 2014. The disclosure of the above application is incorporated herein by reference in its entirety.

FIELD

The present application relates generally to an engine valve lift system and, more particularly, to an engine variable valve lift system that is configured to retain hydraulic fluid relative to actuation components of the variable valve lift system.

BACKGROUND

Engine systems sometimes include variable valve lift (VVL) systems that include electronic or hydraulic actuation, or a combination of the same. For VVL systems that utilize hydraulic or electro-hydraulic actuation control, pressurized hydraulic fluid is typically required in the VVL system components responsible for actuating the associated engine valves. In certain circumstances, such as an extended period of vehicle or engine non-use, hydraulic fluid present in the VVL system during operation of the same may drain out of the VVL system. When this occurs, it may take an extended period of time to replenish the VVL system with hydraulic fluid during a subsequent engine restart event, which may be undesirable to vehicle drivers. Thus, while conventional hydraulically actuated VVL systems work for their intended purpose, there remains a need for improvement in the relevant art.

SUMMARY

In accordance with an exemplary aspect of the invention, an electro-hydraulic actuator system for a variable valve lift system of an engine is provided. In an exemplary implementation, the electro-hydraulic actuator system includes a medium pressure chamber, a high pressure oil circuit, a control valve, a pump and an actuator. The medium pressure chamber is formed in a cylinder head assembly and is adapted to be in fluid communication with a source of hydraulic fluid. The high pressure oil circuit is positioned in the cylinder head assembly and is in selective fluid communication with and receiving hydraulic fluid from the medium pressure chamber. The control valve is positioned in the cylinder head assembly and is in fluid communication with the medium pressure chamber and the high pressure oil circuit, and the pump is configured to pump hydraulic fluid in the high pressure oil circuit. The actuator is in fluid communication with the pump, control valve and high pressure oil circuit, and is adapted to be in engagement with an intake valve of the engine. The control valve is configured to be controlled to selectively block fluid communication between the high pressure oil circuit and the medium pressure chamber thereby providing for the hydraulic fluid pumped by the pump to displace the actuator to open the intake valve. The medium pressure chamber and the actuator are each positioned in the cylinder head assembly at a location higher than the control valve such that during an engine shutdown event, hydraulic fluid is retained in the medium pressure chamber and the control valve.

In one exemplary implementation, the high pressure oil circuit includes an actuator passage formed in the cylinder head assembly and extending between and fluidly coupling the control valve at a valve end and the actuator at an opposed actuator end. In this implementation, the actuator passage is inclined such that the hydraulic fluid flows upwardly in the actuation passage from the valve end toward the actuator end when the engine is in a level operating position.

In one exemplary implementation, the medium pressure chamber includes an upper end and an opposed lower end fluidly coupled to the control valve such that oil flows from the medium pressure chamber downwardly to the control valve when the engine is in a level operating position. In this implementation, the upper end of the medium pressure chamber and the actuator end of the actuator passage are both positioned higher in the cylinder head assembly than the control valve, thereby retaining oil in at least a portion of the medium pressure chamber, the control valve and the actuator passage during extended periods of engine non-use.

In one exemplary implementation, the medium pressure chamber includes a vertically extending stacked-pipe portion extending from an upper portion of the medium pressure chamber defining the upper end to and defining the lower end of the medium pressure chamber, where the vertically extending stacked-pipe portion retaining oil during the extended periods of non-use. In this implementation, the stacked-pipe portion extends vertically from the control valve to a position above the actuator end of the actuator passage and to the upper portion of the medium pressure chamber.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

As briefly mentioned above, the present application relates to an exemplary variable valve lift (VVL) system that is configured to retain hydraulic actuation fluid relative to actuation components of the variable valve lift system. In certain circumstances, such as an extended period of engine non-use, hydraulic fluid present in the VVL system may drain out of the VVL system, typically resulting in an extended period of time to replenish the VVL system with hydraulic fluid during a subsequent engine restart event, which may be undesirable to vehicle drivers.

Accordingly and as will be discussed in greater detail below, the exemplary VVL system of the present application includes an exemplary hydraulic actuation fluid retention arrangement configured to retain the fluid relative to the hydraulic actuation components of the VVL system. In one exemplary aspect, the VVL system includes a high pressure oil circuit in communication with an oil chamber, a control valve, and an intake valve actuator, which are each orientated and positioned in and relative to the high pressure oil circuit such that at least the control valve and a portion of the oil chamber remain in communication with a supply of hydraulic retention fluid during periods of extended engine shutdown.

Figure 1:
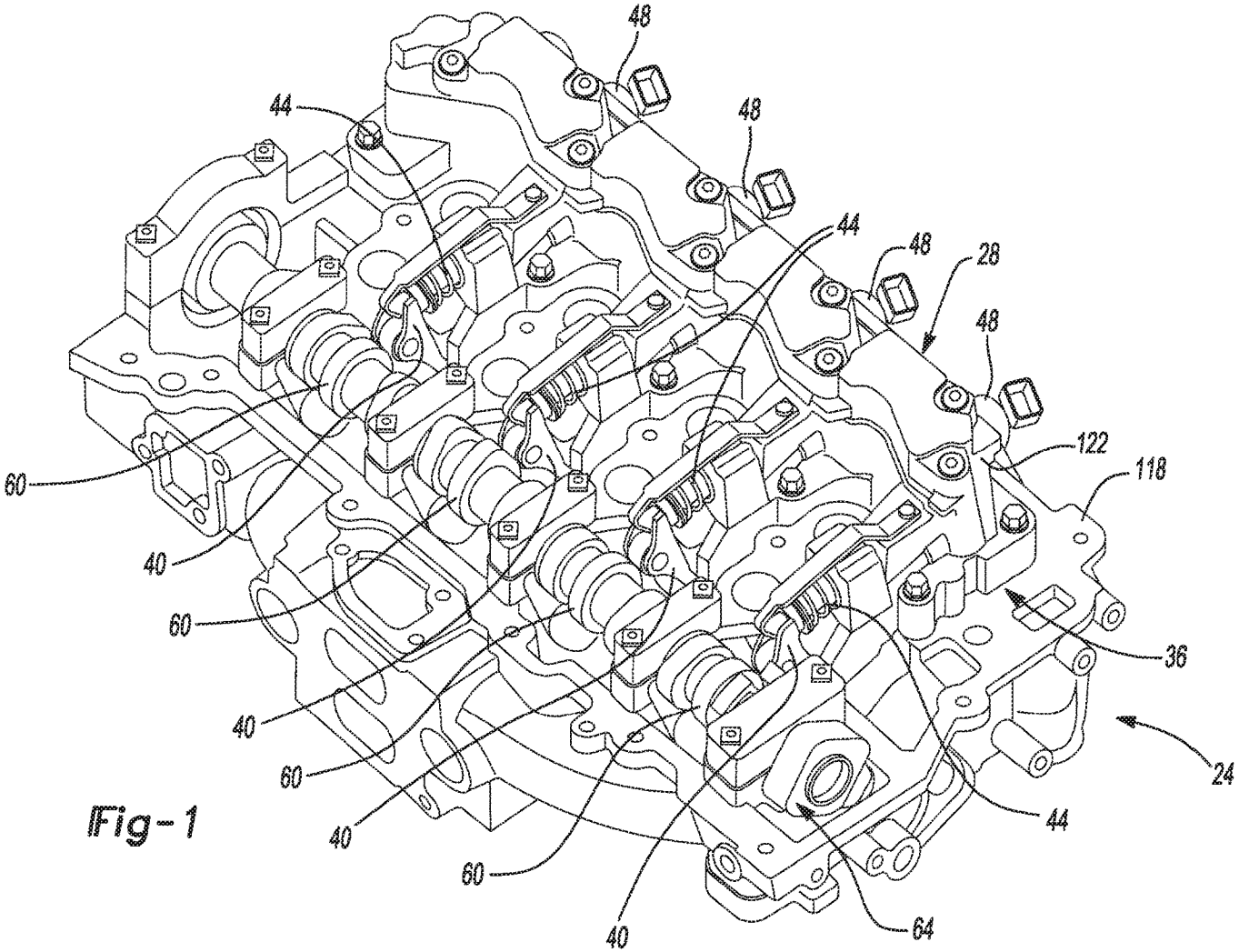
FIG. 1 is a perspective view of a cylinder head assembly including an exemplary variable valve lift (VVL) system in accordance with an aspect of the present disclosure.
Figure 2:
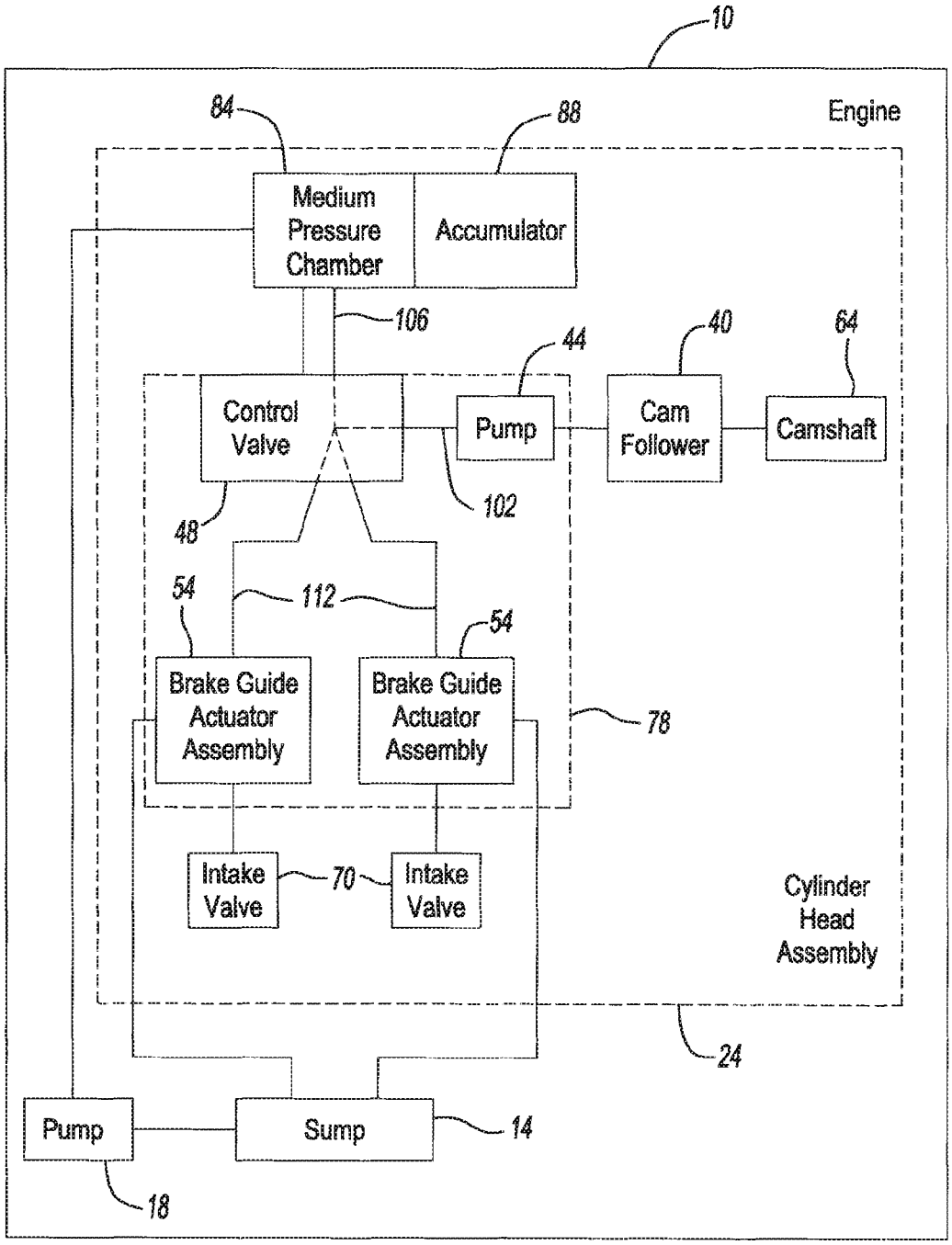
FIG. 2 is a schematic view of an engine having the exemplary the VVL system in accordance with an aspect of the present disclosure.

Turning now to the drawings and with initial reference to FIGS. 1 and 2, an engine is partially schematically shown and generally identified at reference numeral 10. The engine 10, in the exemplary implementation illustrated, includes, among other features, a sump 14, a hydraulic fluid pump 18 and a cylinder head assembly 24. As will be discussed in greater detail below, the cylinder head assembly 24 includes an exemplary variable valve lift (VVL) system 28, which together with the cylinder head assembly 24 provides the exemplary fluid retention arrangement that will be discussed below in greater detail. In an exemplary aspect, the hydraulic fluid utilized in the VVL system 28 is engine oil from the oil sump 14, and the hydraulic fluid pump 18 is an oil pump that pumps the engine oil from the oil sump 14 to various components of the engine 10, as is generally known to those skilled in the art.

With continuing reference to FIGS. 1-2, the VVL system 28 generally utilizes electro-hydraulic variable valve actuation to control air intake (via intake valves) in a gasoline engine. In one exemplary aspect, such control is accomplished without utilizing a throttle valve and is compatible with both naturally aspirated and forced-induction engines. The intake valve or valves of each cylinder of the engine 10 may be individually controlled, allowing for separate timing of each cylinder, as will be discussed in greater detail below.

In one exemplary aspect, the VVL system 28 includes an actuator system 36 having a cam follower 40, a pump/piston 44, an electronically controlled valve 48 and a hydraulic brake guide actuator 54. The cam follower 40 is in movable engagement with a cam lobe 60 of a mechanical camshaft 64 and the brake guide actuator 54 is in engagement with an intake valve 70. In one implementation, the cam follower 40 is a roller finger follower utilizing a pivot. The actuator system 36 works with and/or includes a high pressure oil circuit 78 and a lower pressure or medium pressure chamber 84 that includes an accumulator 88 and is in communication with the control valve 48. The medium pressure chamber 84 is in communication with the oil pump 18, which is in communication with engine oil in the oil sump 14. The piston/pump 44, the electronically controlled valve 48 and the brake guide actuator 54 are each in communication with and/or form part of the high pressure oil circuit 78 together with internal fluid communication passages that are discussed below in greater detail. In an exemplary implementation, the high pressure oil circuit 78 provides a hydro-mechanical link between the camshaft 64 and the intake valve(s) 70, where the hydro-mechanical link is selectively controlled or managed by the electronically controlled valve 48. In one exemplary implementation, the electronically controlled valve 48 is a solenoid valve.

In one example of operation of the actuator system 36, the pump 44 is moved by the intake cam lobe 60 of the camshaft 64 via the cam follower 40 to pump pressurized oil via a first or pump connecting internal fluid passage or gallery 102 of the high pressure oil circuit 78. The high pressure oil circuit 78 is supplied with oil via a second internal fluid connecting passage 106 between the medium pressure chamber 84 and the high pressure oil circuit 78 and/or solenoid valve 48. When the solenoid valve 48 is energized, the valve 48 is in a closed position and the oil pumped from the piston/pump 44 is directly communicated to the brake guide actuator assembly 54 via a third internal fluid passage or gallery 112 of the high pressure oil circuit 78, which in turn moves the associated intake valve 70. When the solenoid valve is de-energized and in an open position, oil is directed from the piston/pump 44 to the medium pressure chamber 84 via the second passage 106 and, as a result, the intake valve or valves 70 are not actuated resulting in a no-lift or zero-lift operating condition. It will be appreciated, however, that the solenoid valve may alternatively be configured to provide actuation when de-energized and provide altered valve lift or no-lift when energized.

The solenoid valve 48 is controlled based on engine and/or driver input to optimize intake air over the entire RPM range of engine 10 to thereby reduce fuel economy and increase engine power. The lift of the intake valves 70 may be controlled to variable positions between no-lift and full lift by selectively controlling the electronically controlled valve 48. For example, the electronically controlled valve 48 may be controlled to vary the supply of pressurized oil to the brake guide actuator assembly 54 associated with each intake valve 70 so as to provide no-lift, full-lift, early intake valve closing (EIVC) and late intake valve opening (LIVO).

Figure 4:
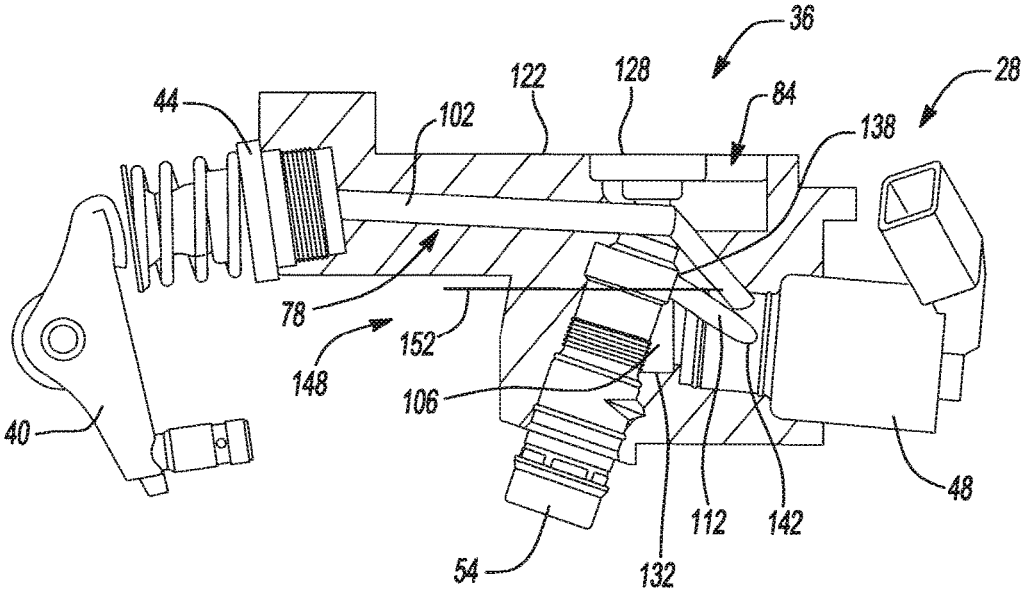
FIG. 4 is a side view of the exemplary cylinder head assembly and VVL system, and showing an exemplary fluid retention arrangement in accordance with an aspect of the present disclosure.
Figure 5:
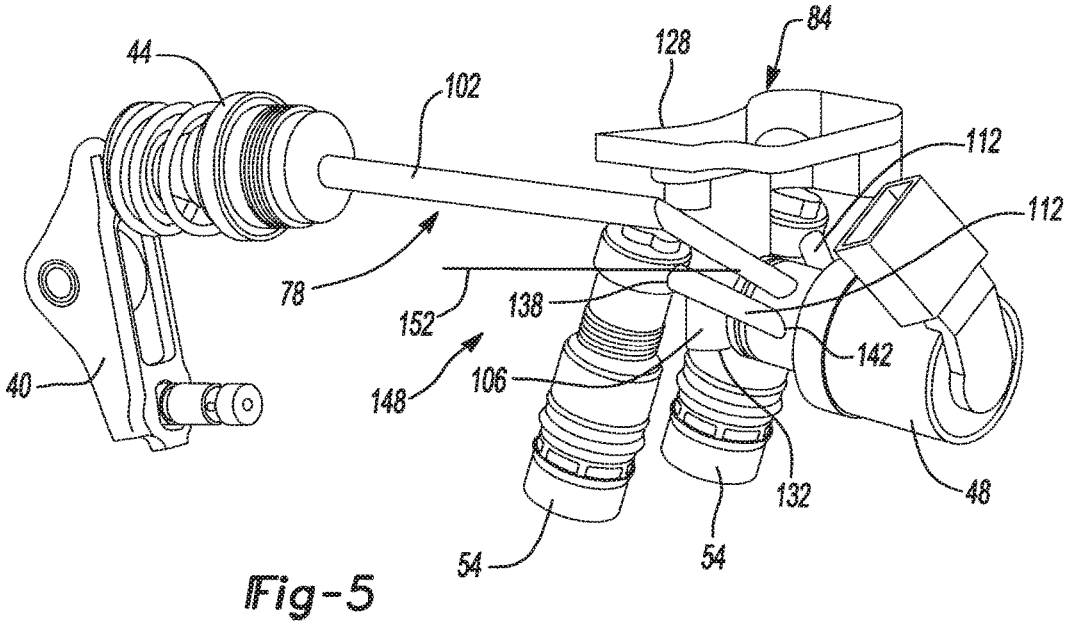
FIG. 5 is a perspective view of the exemplary VVL system including the exemplary fluid retention arrangement in accordance with an aspect of the present disclosure.

In one exemplary aspect and as particularly shown in FIG. 1 with reference to FIGS. 2 and 4-5, each cylinder includes one piston/pump 44, one solenoid valve 48, a high pressure oil circuit 78, a medium pressure chamber 84, and a brake guide actuator assembly 54 in communication with each intake valve 70 associated with that cylinder. In an exemplary implementation, the actuator system 36 including the high pressure oil circuit 78 and medium pressure chamber 84 are included in a cylinder head subassembly configured to be coupled to a cylinder head 118 of the cylinder head assembly 24 such that the brake guide actuators 54 are in communication with the corresponding intake valves 70 and the cam follower 40 is in communication with the corresponding intake cam lobes 64. It will be appreciated, however, that the actuator system 36 may also be integrated directly into the cylinder head 118.

Figure 3:
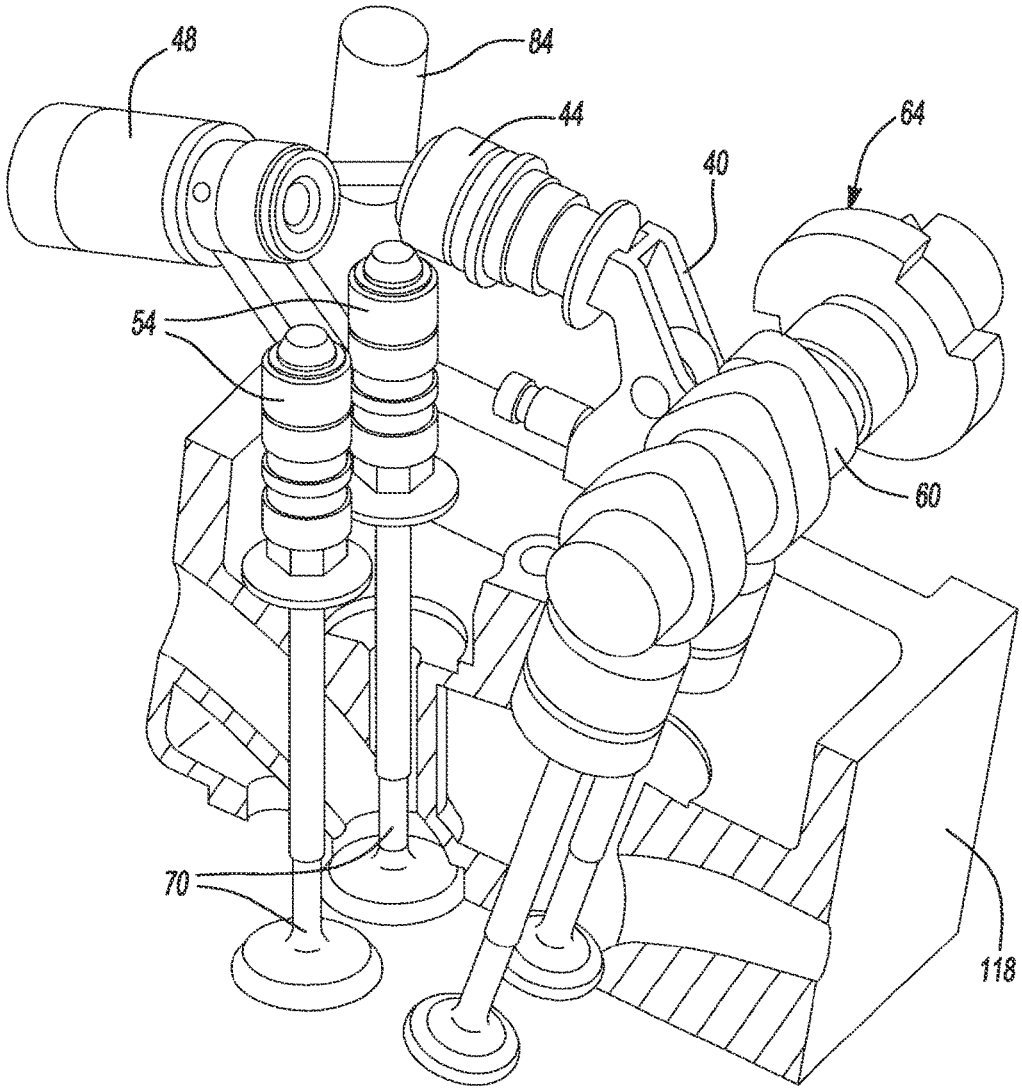
FIG. 3 is a partial perspective view of components of a VVL system in accordance with an aspect of the present disclosure.

In certain potential configurations of the actuator system 36, the medium pressure chamber 84 can be a shallow depth chamber positioned higher than the solenoid valve 48, and the brake guide actuator assembly 54 can be positioned lower than the solenoid valve 48 from a perspective of engine 10 vehicle as assembled into a vehicle, such as shown for example in FIG. 3. In such a scenario, the oil in the medium pressure chamber 84 can drain into the solenoid valve 48 via the second connecting passage or gallery 102 and to the brake guide actuator assembly via the third connecting passage or gallery 112 of the high pressure oil circuit 78.

From the brake guide actuator assembly 54, the oil can drain into the cylinder head 118 and, though drain backs, to the engine oil sump 14. While this drainage is not of concern during operation of the engine 10 due to the slow drainage rate and the medium pressure chamber 84 being supplied with oil from the oil pump 18, there is a potential for oil to drain out of the medium pressure chamber 84, solenoid valve 48 and/or brake guide actuator assembly 54 during extended periods of an engine shutdown, such as when the vehicle is parked or not used for an extended period of time. Under this scenario, there is a potential for an engine restart delay due to a need to re-supply the medium pressure chamber and/or solenoid with oil, without which the intake valves can potentially remain in a no-lift condition.

As a result and with additional reference to FIGS. 4-5, the VVL system 28 and actuator system 36 are configured to provide actuation oil retention in the actuation components of the actuator system 36. In an exemplary implementation and as will be discussed in greater detail below, the medium pressure chamber 84 is sized, shaped and positioned in the actuator assembly 36 and relative to the brake guide actuator assembly 54 and solenoid valve 48 such that actuation oil is retained or trapped in the medium pressure chamber 84 and the solenoid valve 48 during the above-mentioned extended periods of extended engine shutdown or non-use. With this configuration, a supply of oil will remain in at least a portion of the medium pressure chamber 84, second connecting passage 106, the solenoid valve 48, and at least a portion of the third connecting passage(s) 112 of the high pressure oil circuit 78, regardless of the duration of an engine off condition. As a result, upon restart of the engine 10 after an extended period of non-use, a potential delay in actuation of the intakes valves 70 and thus starting of the engine 10 is minimized or eliminated.

With particular reference to FIGS. 4-5, the medium pressure chamber is sized, constructed and formed in a body or housing 122 of the actuator assembly 36 such that, in one exemplary implementation, the connection of the second passage 106 to the solenoid valve 48 and the connection of the third passage 112 to the solenoid valve are both lower than the respective connections of passages 106, 112 to the medium pressure chamber 84 and the brake guide actuator assembly 54, thereby retaining or trapping oil in the solenoid valve 48 and at least a portion of the medium pressure chamber and the third passage 112.

In one exemplary implementation, the second connecting passage 106 is part of or integrated with the medium pressure chamber 84, which is formed in the housing 122. The medium pressure chamber includes an upper side or end 128 and an opposed lower side or end 132. In the implementation where the second connecting passage 106 is considered part of the chamber 84, the lower end of the second connecting passage 106 and the lower end of the chamber 84 are the same, as shown in FIGS. 4 and 5.

Similarly, the third connecting passage 112, which is independent of and fluidly connects the solenoid valve 48 and brake guide actuator assembly 54, is formed in the housing 122 and includes a lower or solenoid end 138 and a higher or second end 142 providing a fluid coupling to the brake guide actuator assembly 54. In this exemplary implementation, the third connecting passage 112 of the high pressure oil circuit 78 connecting the brake guide actuator assembly 54 to the solenoid valve 48 is upwardly inclined (in level vehicle engine position) in a direction from the solenoid valve 48 to the brake guide actuator assembly 54 and a portion of the second connecting passage 106 extends upwardly from the solenoid valve 48 as well.

This configuration creates a trap or retention arrangement 148 for oil in the actuator system 36, as shown for example in FIGS. 4 and 5 by the line 152 indicating the lowest draining level of oil for the VVL system 28. In other words, upon engine shutdown, the oil in the medium pressure chamber 84 (which is no longer being supplied by the oil pump 18), will only drain to the level indicated in FIGS. 4 and 5 by line 152 when the connection of the upper end 138 of the third connecting passage 112 to the brake guide actuator assembly 54 is above the connection at the lower end 132 of the second passage 106 and/or medium pressure chamber 84 to the solenoid valve 48. In this exemplary implementation, the line 152 is at and is defined by the upper end 138 of third passage 112. In one exemplary implementation, oil is retained in the entire third passage 112.

As a result, actuation oil is retained in the medium pressure chamber 84 at or above the upper end 138 of the third connecting passage 112 of the high pressure oil circuit 78, oil is retained in the solenoid valve 48, and oil is retained in at least a portion of the second connecting passage 106 and/or medium pressure chamber 84. As can be seen in FIGS. 4 and 5, the oil is retained at its lowest drained level in a stack or pipe portion (also referred to herein as the second connecting passage 106) of the medium pressure chamber 84 above its lower end 132 inlet to the solenoid valve 48. In one exemplary implementation, the stacked-pipe portion of the medium pressure chamber defines the lower end 132 and extends above the upper end 138 of the third passage 112. In this exemplary implementation, oil is retained in a vertically stacked manner in the stacked-pipe portion 106 of the medium pressure chamber 84.

Merely increasing the size or volume of the medium pressure chamber to provide for a larger volume of oil does not remove the possibility of oil draining from the solenoid valve where the second connecting passage of the high pressure oil circuit is in a declining orientation from the solenoid valve to the brake guide assembly and the brake guide assembly is positioned lower than the medium pressure chamber. Rather, this would only extend the period of time for which it takes to drain the medium pressure chamber of oil. As a result, such a larger medium pressure chamber may still be drained together with the solenoid valve during an extended vehicle shutdown.

It will be understood that various different types of controlled valves may be utilized in the actuator assembly and the medium pressure chamber may include various different pressures and the term "medium" is not limiting. It will also be understood that each cylinder may include one or more intake valves and a single or multiple solenoid valves may be utilized for each cylinder in conjunction with a brake guide assembly for each associated intake valve of that cylinder.

It will be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. An electro-hydraulic actuator system for a variable valve lift system of an engine, the electro-hydraulic actuator system comprising:

a medium pressure chamber formed in a cylinder head assembly and adapted to be in fluid communication with a source of hydraulic fluid;

a high pressure fluid circuit positioned in the cylinder head assembly and in selective fluid communication with and receiving hydraulic fluid from the medium pressure chamber;

a control valve positioned in the cylinder head assembly and in fluid communication with the medium pressure chamber and the high pressure fluid circuit;

a pump configured to pump hydraulic fluid in the high pressure fluid circuit; and an actuator in fluid communication with the pump, control valve and high pressure fluid circuit, the actuator in engagement with an intake valve of the engine;

wherein the high pressure fluid circuit includes a first fluid passage fluidly coupled between the pump and the control valve, and a second fluid passage fluidly coupled between the control valve and the actuator, the second fluid passage having a valve end coupled to the valve and an opposite actuator end coupled to the actuator, the second fluid passage inclined such that the hydraulic fluid flows upwardly in the second fluid passage from the valve end toward the actuator end when the engine is in a level operating position;

wherein the control valve is configured to be controlled to selectively block fluid communication between the high pressure fluid circuit and the medium pressure chamber thereby providing for the hydraulic fluid pumped by the pump to displace the actuator to open the intake valve; and wherein the medium pressure chamber and the actuator are each positioned in the cylinder head assembly at a location higher than the control valve such that during an engine shutdown event, hydraulic fluid is retained in the medium pressure chamber and the control valve.

2. The actuator system of claim 1, wherein the medium pressure chamber includes an upper end and an opposed lower end fluidly coupled to the control valve such that fluid flows from the medium pressure chamber downwardly to the control valve when the engine is in a level operating position.

3. The actuator system of claim 2, wherein the upper end of the medium pressure chamber and the actuator end of the second fluid passage are both positioned higher in the cylinder head assembly than the control valve, thereby retaining fluid in at least a portion of the medium pressure chamber, the control valve and the second fluid passage during extended periods of engine non-use.

4. The actuator system of claim 3, wherein the actuator system is configured to retain fluid in the second fluid passage such that fluid is retained in all of the second fluid passage from the valve end to the actuator end.

5. The actuator system of claim 3, wherein the medium pressure chamber includes a vertically extending stacked-pipe portion extending from an upper portion of the medium pressure chamber defining the upper end to and defining the lower end of the medium pressure chamber, the vertically extending stacked-pipe portion retaining fluid during the extended periods of non-use.

6. The actuator system of claim 5, wherein the stacked-pipe portion extends vertically from the control valve to a position above the actuator end of the second fluid passage and to the upper portion of the medium pressure chamber.

7. The actuator system of claim 1, wherein the pump is in engagement with a camshaft of the cylinder head assembly and is actuated by the same.

8. The actuator system of claim 1, wherein the medium pressure chamber includes an accumulator.

9. The actuator system of claim 1, wherein the actuator is a brake guide actuator operably associated with an intake valve.

10. The actuator system of claim 1, wherein the first fluid passage is separate from the second fluid passage.

11. An electro-hydraulic actuator system for a variable valve lift system of an engine, the electro-hydraulic actuator system comprising:

a housing;

a pump configured to pump hydraulic fluid;

a hydraulic brake guide actuator configured to engage an intake valve of the engine;

a control valve configured to selectively supply the hydraulic fluid to the hydraulic brake guide actuator;

a medium pressure chamber formed in the housing and configured to receive a supply of the hydraulic fluid;

a first fluid passage formed in the housing and fluidly coupled between the pump and the control valve;

a second fluid passage formed in the housing and fluidly coupled between the control valve and the hydraulic brake guide actuator, the second fluid passage being separate from the first fluid passage and inclined such that hydraulic fluid must travel upwardly from the control valve to the hydraulic brake guide actuator; and a third fluid passage formed in the housing and fluidly coupled between the medium pressure chamber and the control valve;

wherein a lowest point of the control valve is disposed below a lowest point of the medium pressure chamber and a lowest point of the second fluid passage; and wherein a highest point and the lowest point of the second fluid passage are disposed above the lowest point of the medium pressure chamber.

* * * * *